US005741047A

United States Patent [19]

Ordonez

[11] Patent Number: 5,741,047

[45] Date of Patent: Apr. 21, 1998

[54] ROOFING MATERIAL STRIPPING MACHINE

[76] Inventor: Rudy Ordonez, 3036 W. Mariposa, Phoenix, Ariz. 85017

[21] Appl. No.: 630,003

[22] Filed: Apr. 9, 1996

[51] Int. Cl.[6] ..... E04D 15/02

[52] U.S. Cl. ..... 299/37.1; 30/170; 81/45

[58] Field of Search ..... 299/37.1; 30/169, 30/170; 81/45; 15/93.1

[56] References Cited

U.S. PATENT DOCUMENTS 2,519,138 8/1950 Katz ..... 299/37.1

3,726,565 4/1973 Oliverius ..... 299/37.1

4,837,933 6/1989 Chapman ..... 30/170

*Primary Examiner*—David J. Bagnell

*Attorney, Agent, or Firm*—Gregory J. Nelson

[57] ABSTRACT

A shingle stripping tool having a wheel supported frame including a rearwardly extending handle with a grip at the upper end. A power transmission includes a drive shaft extending along the handle which is driven by a motor. A reciprocally driven blade is supported on a sliding fulcrum. The blade is connected to the gear wheels at an eccentric arrangement whereby the blade is driven in a reciprocal and rotating motion to strip and clear debris.

12 Claims, 4 Drawing Sheets

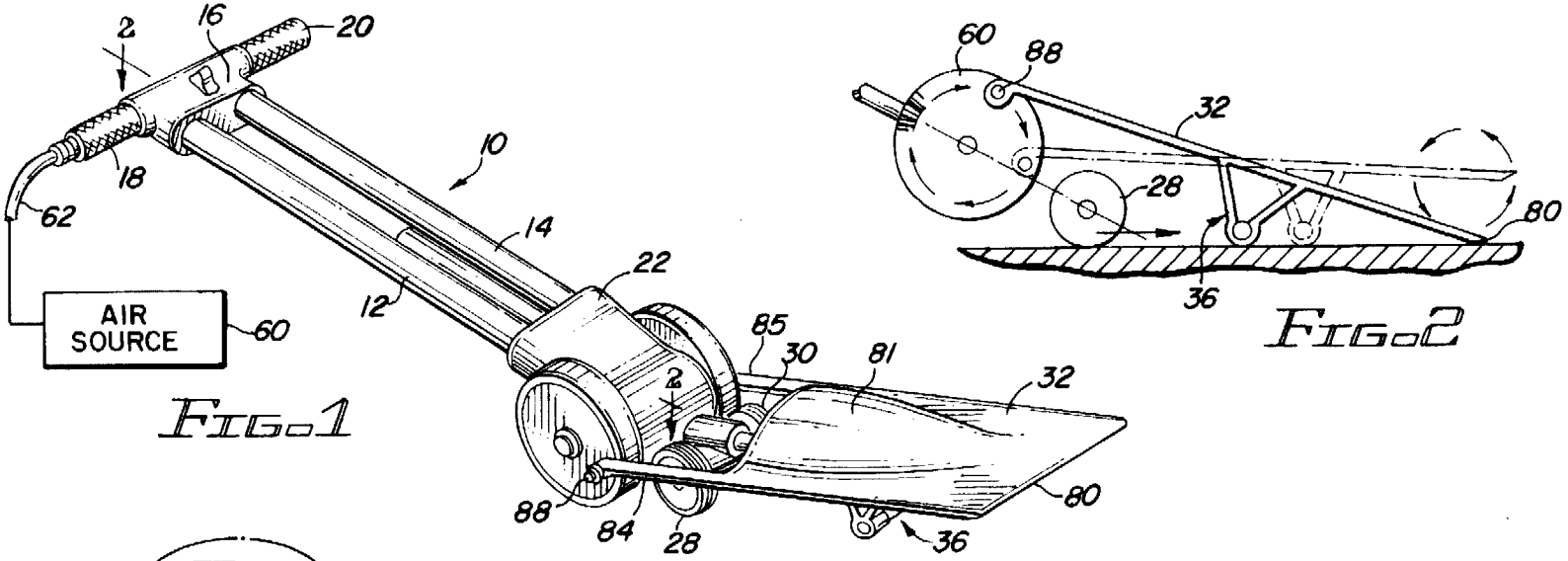
FIG. 1
FIG. 2
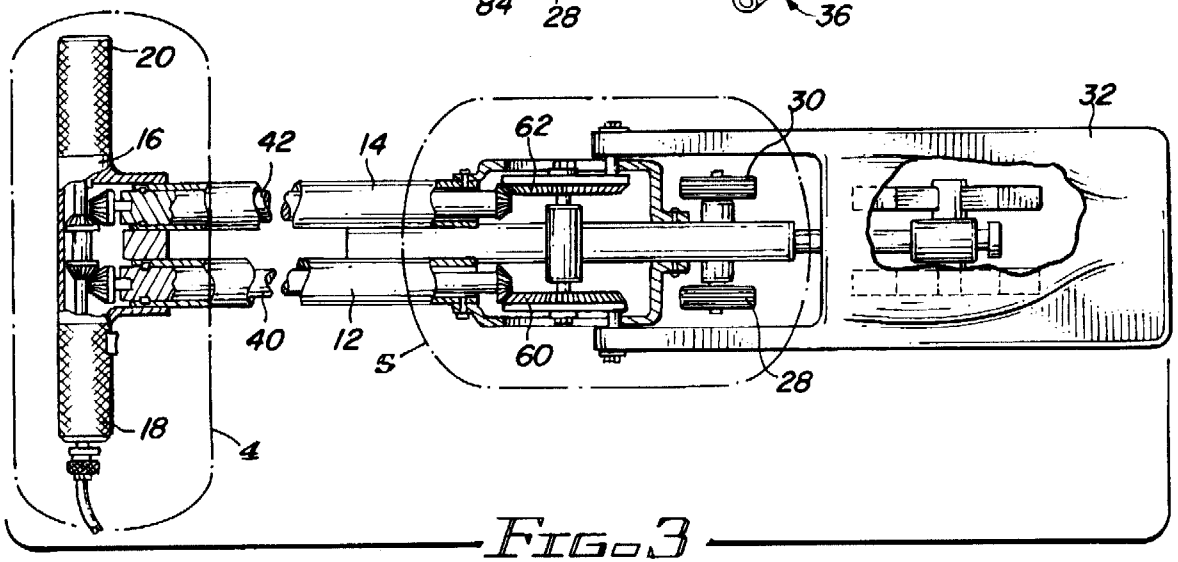
FIG. 3

ROOFING MATERIAL STRIPPING MACHINE

FIELD OF THE INVENTION

The present invention relates to a machine for removing or stripping materials such as shingles from a roof deck and more particularly relates to a motor driven deuce of this type, sometimes referred to in the roofing industry as a motorized spud shovel.

BACKGROUND OF THE INVENTION

Residential and commercial building construction generally have roof decks which are covered with a protective layer of shingles or other roofing material. Shingles are generally placed in overlapping, aligned rows and the shingles are secured in place by a combination of adhesives, nails, staples or other fasteners. Another conventional roof construction is the built-up roof in which utilizes rolled roofing material having an asphaltic base which is laid in strips in overlapping or abutting relationship. The strips are secured to the deck by use of adhesives or fasteners. Periodically, as weathering occurs, it becomes necessary to remove the old roof covering and replace the roofing material with new material. Accordingly, various tools and apparatus can be found in the prior art to assist roofers in stripping the old material from the roof deck.

A tool commonly used for this purpose is a simple flat edged shovel which is manually forced under the shingles and rips the shingles and fasteners from the roof deck. Other improved manual devices can be found as, for example, U.S. Pat. No. 4,466,188 which shows a manual roofing remover having a wedge-shaped head. Motorized devices for removing or stripping roofing material are also known.

U.S. Pat. No. 4,277,104 shows a power-driven device for removing shingles from a roof surface which has a reciprocating plate having a notched forward end that moves along a concave arc during reciprocation.

U.S. Pat. No. 4,691,439 shows a powered apparatus for stripping shingles which is shovel-like having a blade and slots. Power means lower and raise the blade so that when the blade is lowered it moves under the shingles. The blade is then raised to exert leverage and detach the shingles and the slots engage the nails to pull them out.

U.S. Pat. No. 4,663,995 shows another shovel-like device for removing roofing material having a lifting blade including a blade-like leading section and a trailing section. Actuator means in the form of a cylinder will depress the trailing section of the lifting plate to rotate the lifting plate pulling fasteners and roofing material away from the roof deck.

U.S. Pat. No. 4,763,547 discloses a shingle stripping tool having a frame and a power head. The power head has a fulcrum and lift plate for articulating movement about a pivot axis. A pneumatically powered drive pivots the lifting plate.

U.S. Pat. No. 4,756,578 discloses an apparatus for removing shingles which has a mobile frame and has a blade pivotally attached to the front end of the frame. The blade is movable between an upper and lower position. An air cylinder will selectively lift the blade from the lower position to the upper position. As the blade is advanced, the blade is wedged between the roof shingles and roof deck.

U.S. Pat. No. 4,837,993 describes a machine which travels over the roof surface and has a separating structure reciprocally positionable between a forwardly directed separating engagement position with the material and a lifting position. The drive has an eccentrically configured cam which periodically or reciprocally engages a portion of the separating means causing its reciprocal and pivotal movement relative to the frame.

U.S. Pat. No. 5,001,946 discloses an apparatus for removing shingles which includes an elongate body with a handle and a pivotally connected lift plate at the lower end. A piston and cylinder are activated by a trigger. The lift plate is pivotally mounted and a toggle linkage connects the actuator to the lift plate pivoting the forward edge of the plate about a heel structure.

Thus, from the foregoing, it will be seen that there are numerous manually operable and powered devices for removing shingles. While some of the devices are effective, they generally have not achieved acceptance within the industry for a number of reasons. Often the devices are cumbersome and heavy and are not convenient to use on a roof. Another disadvantage of prior art devices is that they often operate simply to raise and lower to remove shingles. In other words, the devices do not operate in a manner which effectively "stabs" the interface between the roof deck and shingle and thereafter lifts the shingle and "pops" any mechanical fasteners and then will withdraw to escape debris.

Thus, from the foregoing, it will be apparent that there exists a need for an effective shingle/roofing material removing device which is convenient to use. While the present invention is described with reference to a roofing material stripping device, it will be apparent that a device of the type to have other applications such as removal of flooring material such as a carpet, tile or any other application where a layer of material is to be stripped from an underlying substrate.

SUMMARY OF THE INVENTION

The present invention constitutes an improvement over prior art motorized shingle removers which are sometimes referred to as "spud" shovels. The device of the present invention has an elongate handle with oppositely extending grips at the upper end. A power transmission includes one or more axially extending drive shafts which are operatively connected to an air motor. The lower end of the drive shafts each carry a bevel gear which engage corresponding gears on a drive wheel which drive wheel is mounted on a transversely extending horizontal axis. The outer surface of each drive wheel carries an eccentrically mounted pivot pin. The drive wheels are connected to a blade by a pair of forwardly extending links or arms. The forward end of the blade serves to effectively remove shingles, building materials and fasteners. One or more wheels support the device to allow the operator to manually advance and retract the device.

The blade carries a fulcrum having feet or a skid plate which engages the roofing surface. The fulcrum is axially slidable along a forwardly extending shaft at a sleeve arrangement. When the operator activates the motor, the transmission will rotate the drive wheels causing the forward end of the blade to move in a generally circular path in which the blade stabs the interface between the roofing material and the roof deck and then rotates upwardly and rearwardly to remove the material and any fasteners and also to rotate free of the debris. Once the blade has exerted leverage to detach shingles and nails in an area, the apparatus can be rocked or moved forwardly by the operator on the wheels.

In an alternate embodiment, the power transmission includes a motor having an output shaft which, directly or indirectly through a gear set, drives the drive wheels:

The above and other objects and advantages of the present invention will become more apparent from the following description, claims and drawings in which:

FIG. 1 is a perspective view of the machine of the present invention with the machine shown connected to a source of pressurized air;

FIG. 2 is an elevational view of the front end of the machine with arrows showing the reciprocatory motion that is imparted to the forward end of the blade to stab, lift and rotate free of debris;

FIG. 3 is a top view of the machine of the present invention partly broken away to better illustrate the components;

DESCRIPTION OF THE INVENTION

Figure 4:
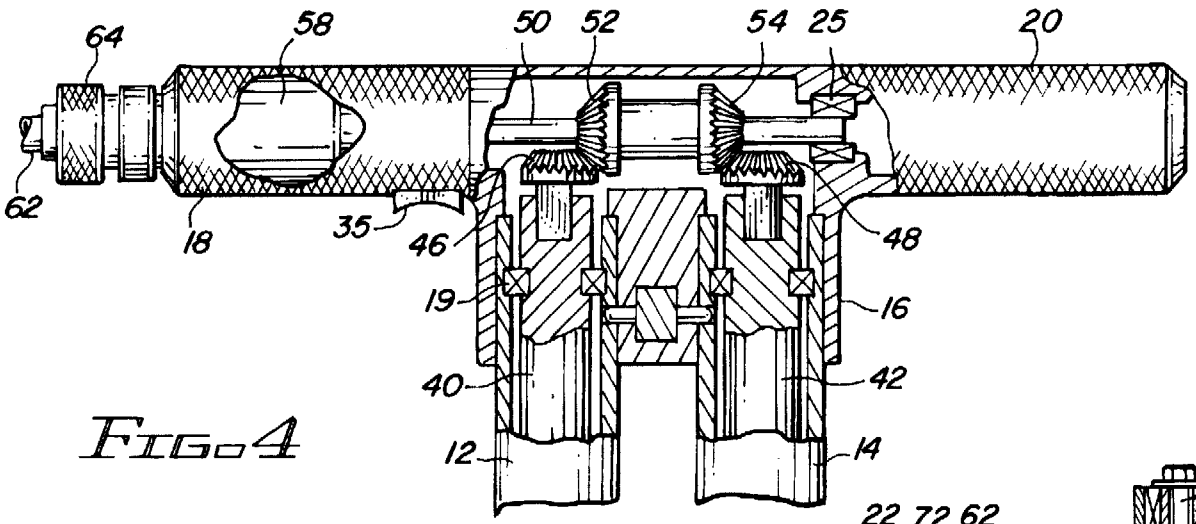
FIG. 4 is a enlarge detail view of the upper end of the handle and grips, partly broken away for clarity.

Referring to the drawings, the device of the present invention is generally designated by the numeral 10 and has a pair of elongate, tubular handles 12 and 14 which are joined at their upper end to a housing 16 having oppositely extending grips 18 and 20. The lower end of the handle members 12 and 14 terminate at housing member 22 which is supported for movement on wheels 28 and 30. A blade 32 is supported on fulcrum assembly 36 and, as will be explained hereafter, is driven in a rotating and reciprocal path to efficiently remove material such as shingles.

As best seen in FIGS. 3 and 4, the handle members 12 and 14 are hollow and have internal bearings 19 for supporting rotating drive shafts 40 and 42 which are respectively provided with bevel gears 46 and 48 at their upper ends. Transversely extending grips 18 and 20 extend from the housing 16 at the upper end of the handle. A shaft 50 extends transversely within the grips and is mounted in suitable bearings 25. A pair of gears 52 and 54 are provided at spaced-apart locations along the shaft 50 and are in driving engagement with gears 46 and 48, respectively. Suitable drive means are provided to impart rotation to shaft 50. The drive means may be electrical or mechanical or, as shown, an air motor 58 of conventional design may be provided within the grip 18 and the output shaft of the air motor coupled to shaft 50. Air motor 58 is connected to a suitable source of pressurized air 60 by means of air hose 62 at quick disconnect coupling 64.

The exterior of grips 18 and 20 may be knurled or provided with a resilient covering for the comfort and convenience of the user. The gear motor is actuated by means of a trigger 35 on grip 18 adjacent housing 16.

The lower end of the drive shafts 40, 42 terminate at a pair of bevel gears 60 and 62. A tubular frame member 65 extends intermediate the handles 12 and 14 and projects from the forward end of the housing 22. The tubular frame member 65 is formed having a slight angular configuration so that when the lower end of the tube 65 is substantially parallel with the working surface, the handles 12 and 14 extend rearwardly and upwardly at an angle of about 30° to 45° with respect to the working surface placing the grips at a convenient height for the user.

Figure 5:
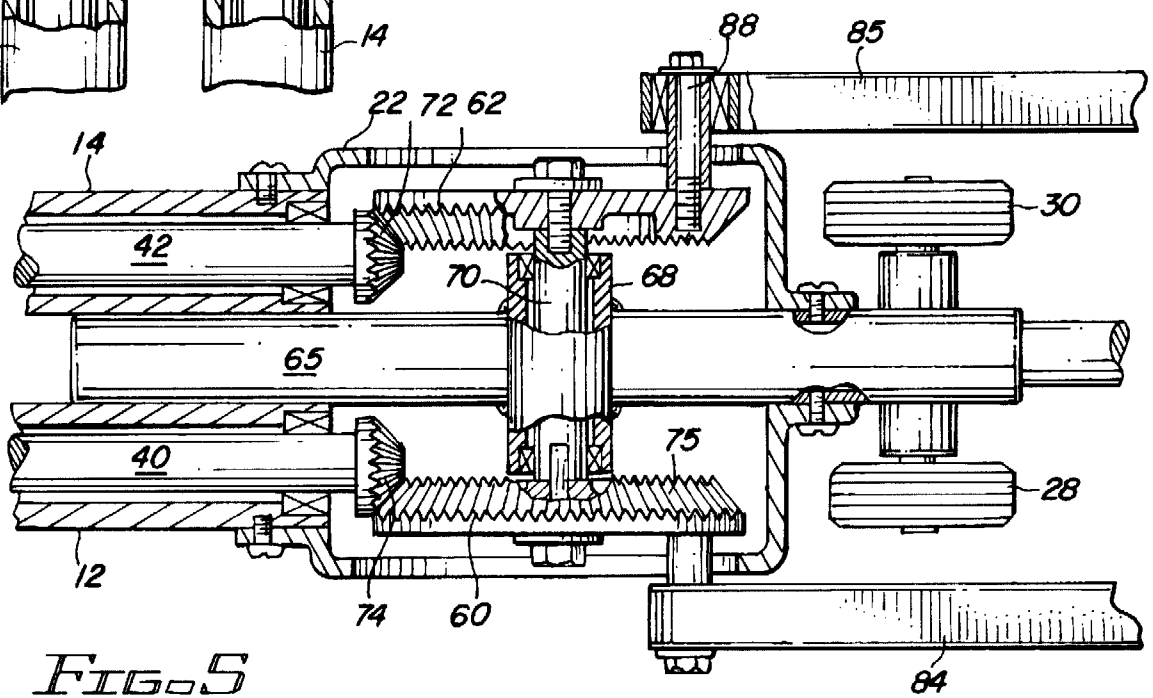
FIG. 5 is a detail view of a portion of the drive mechanism or transmission as indicated in FIG. 3.

As best seen in FIG. 5, a journal 68 extends transversely of tubular member 65 within the housing 22. Shaft 70 is rotative within the journal 68. The opposite ends of the shaft 70 are threaded to receive drive wheels 60 and 62 which are secured by appropriate washers and fasteners 75.

The interior faces of the drive wheels 60, 62 each have teeth 75 which are in driven engagement with the bevel gears 72 and 74 at the lower ends of the drive shaft. Thus, it will be seen that when the air motor is actuated, the power transmission consisting of shaft 50, drive shafts 40, 42, and shaft 70 transmit rotary motion to drive wheels 70, 72.

The blade or shovel 32 has a leading edge 80 which engages the material to be removed and the fasteners. The blade is preferably of a suitable durable material such as a high carbon steel and is provided with an axially extending upwardly projecting central dome 81 which assists in shedding material from the upper surface of the blade. Rearwardly extending arms 84, 86 are pivotally attached to the drive wheels 60, 62, respectively, at pivot shafts 88. Pivot shafts 88 are shown as bolts which are in threaded engagement with internally threaded bores in the drive wheels. The location of the pivot shafts 88 is radially offset from the central transverse axis of the wheels so that as the drive wheels rotate, reciprocatory circular motion, as seen in FIG. 2, is imparted to the leading edge 80 of the blade.

Figure 8:
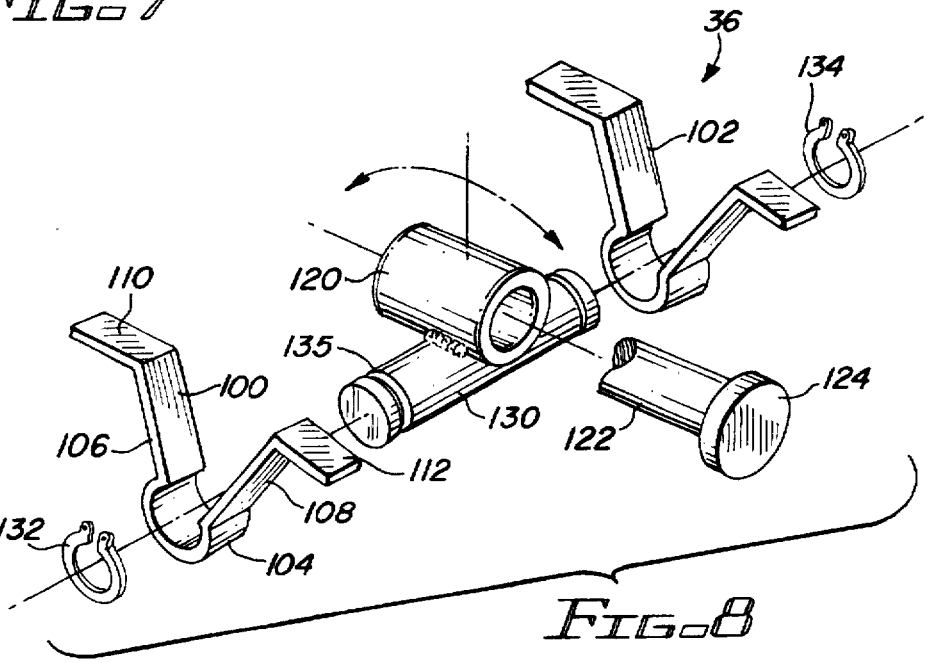
FIG. 8 is an exploded view of the fulcrum and blade support assembly.

The blade or shovel 32 is supported by a fulcrum assembly 36 which has a pair of generally V-shaped fulcrums 100, 102. The fulcrum assemblies are best seen in FIG. 8 and each of the fulcrums 100, 102 has an arcuate section 104 from which a pair of diverging arms 106 and 108 extend terminating at flanges 110 and 112. The flanges 110, 112 are secured to the underside of the blade 32 within the area of dome 81 by welding or appropriate mechanical fasteners.

Since the eccentric motion imparted by the drive wheels imparts both a reciprocating and a rotary motion to the blade, the fulcrum must be allowed to axially reciprocate. To accommodate this motion, a sleeve 120 is slidable along forwardly extending shaft 122 which shaft has a stop 124 at its outer end. A transverse axle 130 is secured as by welding to the underside of the sleeve 120 and the arcuate sections 104 of the fulcrum members receive the opposite ends of the axle. The assembly is completed by snap rings 132 and 134 which are received in annular grooves 135 at the opposite ends of the axle 130.

A better understanding of the present invention will be had from the following description of operation.

The machine of the present invention is positioned on the surface from which material is to be removed such as a shingled roof. The operator positions himself or herself behind the machine. The machine is connected via air hose 62 to a source of compressed air 60. The operator grips the handle and may advance the device on wheels 28 and 30. The device is actuated by depressing the trigger 16 which will energize the air motor 58 causing the output shaft 50 to rotate. The rotation of the output shaft imparts rotation to parallel drive shafts 40 and 42 which, in turn, imparts rotation to the drive wheels 60 and 62. The rotation of wheels 60, 62 will transmit an oscillatory and reciprocal motion to the blade as seen in FIG. 2. The blade 32 reciprocates with sleeve 120 along the forwardly extending shaft 122. The fulcrum assembly 36 also moves back and forth along the work surface as the forward or leading edge of the blade 80 rotates and reciprocates.

The operator, by use of the grips, advances the leading edge 80 of the blade beneath the roofing material to be removed. As the leading edge 80 contacts the underside of the shingles, the shingles and any fasteners are lifted upwardly along with the fastener such as staples or nails. After the leading edge has lifted a section of shingles from the surface, the blade continues in a rearward motion free of the debris. The operator then proceeds forwardly so that the blade is positioned between the next remaining layer of shingles and removal is accomplished in a similar manner. The operator can proceed rapidly and safely as removal is accomplished by the power means rather than by manual application of force.

The device is effective to remove roofing material and securing fasteners in a single operation. The reciprocal and rotational movement of the leading edge of the blade removes the shingles and removes the blade clear of the debris preventing strip material from accumulating in the working area in the path of the machine. The dome shape of the blade keeps material from accumulating thereon as material is shed from the blade. Although not recommended, the machine can be operated with one hand, use of the machine significantly decreases manpower needed to strip a roof.

Figures 9, 10:
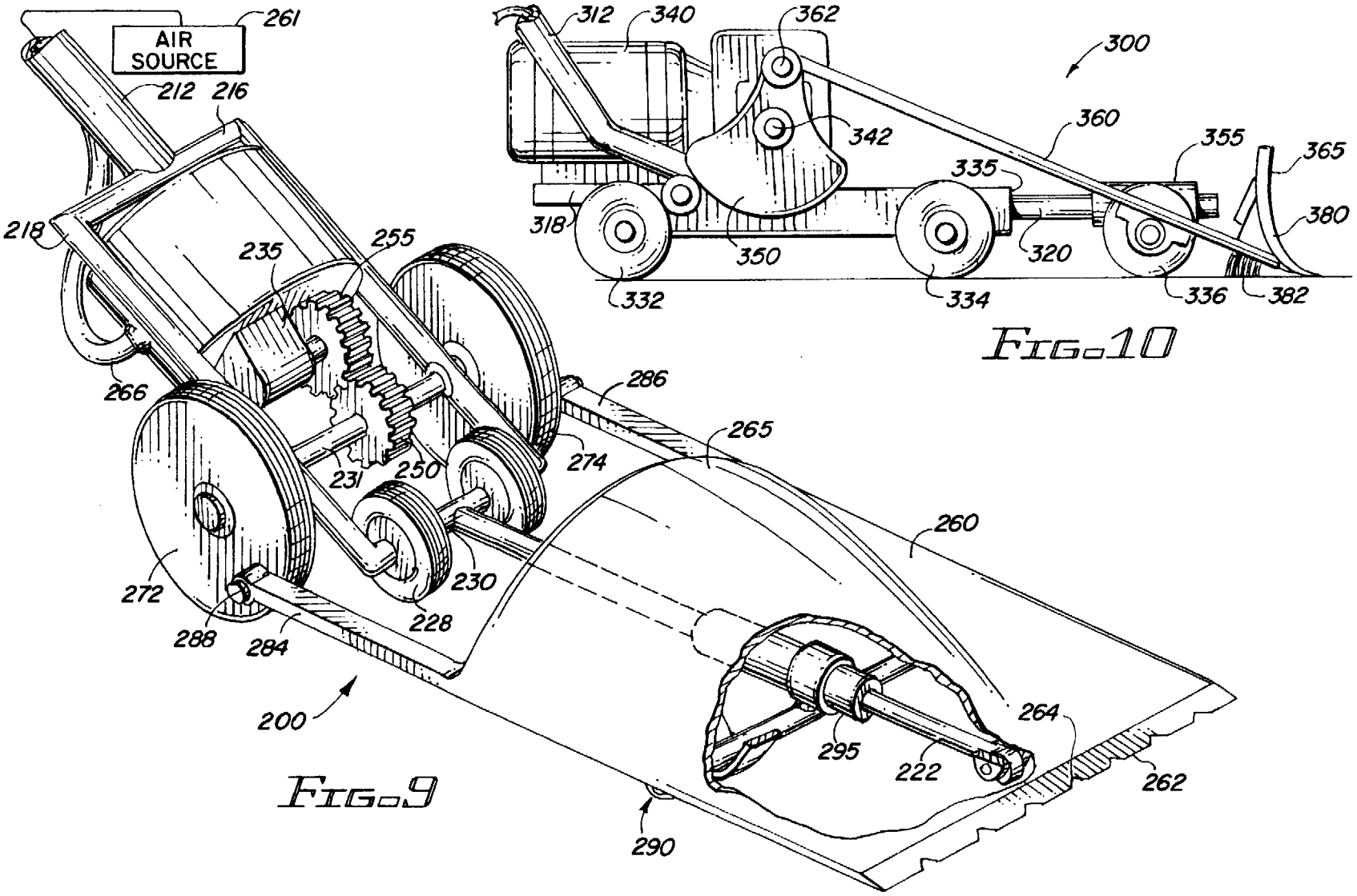
FIG. 9 is a perspective view of an alternate embodiment of the roofing material stripping machine of the present invention.
FIG. 10 is a side view of yet another embodiment of the present invention.

An alternate embodiment of the roofing machine of the present invention is shown in FIG. 9 which is generally designated by the numeral 200. The embodiment of the invention of FIG. 9 has an elongate tubular handle 212 with oppositely extending grips at the upper end of the handle. The lower end of the handle is configured having a generally rectangular frame member with longitudinally extending arms 218 which support a transverse axle 230 at the lower end. The device is supported for movement on wheels 228 carried on transverse axle 230.

Blade 260 is similar or identical in construction to blade 32 described above and shown in FIGS. 6 and 7. The blade has a leading edge 262 having notches 264 which engage the material to be removed along with the fasteners holding the material. The blade is preferably made of a suitable material such as a high carbon steel and has an axially extending central dome 265. Rearwardly extending arms 284 and 286 are pivotally attached to drive wheels 272 and 274 at pivot shafts 288 which pivot shafts are radially offset from the central transverse axis of the wheels so that as the gear wheels rotate, reciprocatory circular motion as seen in FIG. 2 is imparted to the leading edge of the blade. The gear wheels are commonly carried on a transverse axle 231 which is suitably mounted in journal bearings at a location within or secured to frame members 216 and 218.

Shaft 231 carries a gear 250 shown as a bevel gear which is in engagement with gear 255. Gear 255 is carried on the output shaft of air motor 235. The output shaft of the air motor is secured for rotation in suitable bearings at frame member 216. The air motor may be of any suitable conventional type and is connected to a pneumatic source 261 by air line 263 which extends along the upper grip handle 212 and frame member 218 to the motor. As has been described above, a suitable actuator switch is provided on the handle to allow the operator to control the machine by selectively directing air to the air motor.

Figure 6:
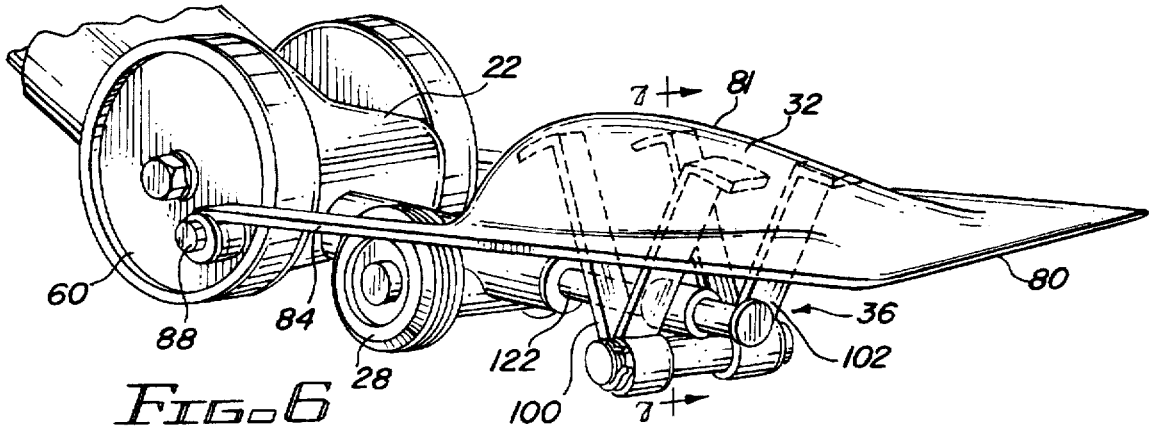
FIG. 6 is an enlarged, perspective view of the front end of the machine and the blade.
Figure 7:
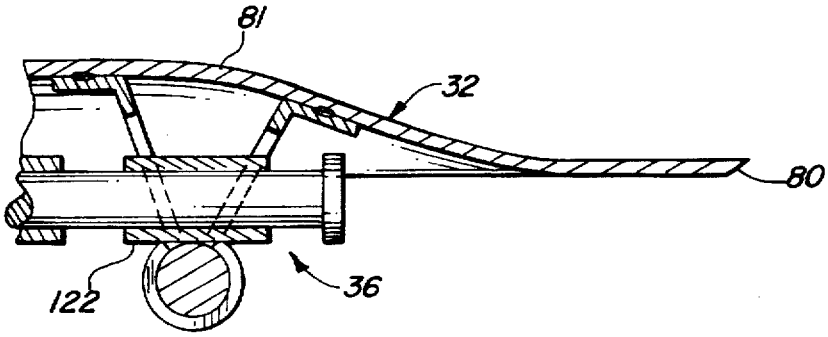
FIG. 7 is a sectional view taken along line 7—7 of FIG. 6.

The blade 260 is supported by a fulcrum assembly 290 which is essentially identical to the fulcrum shown in FIGS. 6 and 7. To accommodate the reciprocating rotary motion of the blade, a sleeve 295 is slidable along forwardly extending shaft 222 which is attached to shaft 231. The device of FIG. 9 operates in a manner essentially the same as has been described above with reference to previous drawing figures. The device is connected by an air hose 263 to a source of compressed air 261. The device is actuated by manually depressing the switch or trigger imparting rotation to gear 255 and driven gear 250. The rotation of gear 250 imparts rotation to shaft 231 which causes drive wheels 270 and 272 to rotate. Rotation of the drive wheels will transmit oscillatory reciprocal motion to the blade.

As the leading edge 262 of the blade contacts the underside of the roofing material, such as shingles, the shingles and any fasteners are lifted upwardly. The notches 264 assist in removal. After the leading edge of the blade has lifted a section of the shingles, the blade continues in a rearward motion free of the debris. The operator proceeds in this manner to remove remaining shingles. The device decreases the labor required for removal of roofing materials.

While the device is shown as being pneumatically operated, other power means such as an electric or hydraulic motor, could be used to provide the necessary power to the blade. However, it is conventional that roofers have a source of pneumatic power available since pneumatic-driven nailing guns are in common use.

In FIG. 10, another embodiment of the invention is shown which is generally designated by the numeral 300. It will be appreciated that this view is a right side view and that the left side view is a mirror image thereof. The machine has a handle 312 which supports a frame 318 having forwardly projecting arms 300. The machine is supported for movement on rear wheels 332 and intermediate wheels 334. Front wheels 336 are reciprocable on arms 320 at linear bearing 335.

The machine is powered by a motor 340 which may be hydraulic, pneumatic or electric with controls suitably located on the handle. The output shaft 342 causes drive wheels 350 to rotate. The drive wheels 350 are connected to the opposite sides of blade assembly 360 at pivot shafts 362. The drive wheels may be non-circular and weighted as a counterbalance to provide smooth rotation. Rotation of the drive wheels will cause the blade assembly 360 to reciprocate to remove roofing material and fasteners. The blade 365 is concave at 380 and includes a rearwardly mounted brush 382 to assist in sweeping away and removing debris.

The weight, design and configuration of the device allows the operator to conveniently transport and use the device. Another advantage is that the device allows the operator to work in a substantially erect position reducing stress and strain on the operator, particularly reducing the possibility of back injury.

While the principles of the invention have been made clear in the illustrative embodiments set forth above, it will be obvious to those skilled in the art to make various modifications to the structure, arrangement, proportion, elements, materials and components used in the practice of the invention. To the extent that these various modifications do not depart from the spirit and scope of the appended claims, they are intended to be encompassed therein.

I claim:

1. A machine for stripping material from a generally planar substrate comprising:

(a) a frame having an upper and lower end, said frame being supported on wheels and having guide means;

(b) power transmission means having power means and at least one drive wheel disposed at the lower end of said frame;

(c) a blade with a leading edge, said blade being supported on a fulcrum engageable with the substrate, said fulcrum being axially reciprocal along said guide means; and (d) said blade having arms extending rearwardly and being eccentrically connected to said drive wheel whereby upon actuation of said power means, said blade is driven through said power transmission means in a reciprocatory, rotating motion to strip and remove material.

2. The machine of claim 1 wherein said power transmission means comprises parallel drive shafts having gears at their upper ends and being in driven engagement with said power means and said drive shafts having gears at their lower ends being in driven engagement with said drive wheel.

3. The machine of claim 1 wherein said fulcrum is generally V-shaped having skid means thereon.

4. The machine of claim 1 wherein said blade has a generally domed configuration.

5. The machine of claim 1 including a pair of drive wheels each driven by said power transmission means.

6. The machine of claim 5 wherein said power transmission means comprises a drive shaft extending between said drive wheels having a driven gear thereon in driving engagement with said wheel.

7. The machine of claim 1 wherein said power means comprises an air motor.

8. The machine of claim 1 wherein said power transmission means includes gear means and said power means comprises a motor.

9. A machine for stripping material from a planar surface such as a roof comprising:

(a) a frame having a handle and being supported on wheels and having a generally axially extending slide member;

(b) power means on said frame having an output shaft;

(c) a drive wheel rotatively driven by said output shaft;

(d) a wheel attached to said slide member at bearing means for reciprocation;

(e) a blade having an arm pivotally secured to said drive wheel at a distal end and being secured to said bearing means whereby rotation of said drive wheel imparts generally axial reciprocal motion to said blade to strip and remove material.

10. The machine of claim 9 wherein said blade has a curved surface.

11. The machine of claim 9 wherein said blade includes a brush.

12. The machine of claim 9 wherein said drive wheel is counterbalanced.

* * * * *